US007080532B2

(12) United States Patent
Bücker et al.

(10) Patent No.: US 7,080,532 B2
(45) Date of Patent: Jul. 25, 2006

(54) VEHICLE DOOR CLOSURE

(75) Inventors: Rolf Bücker, Coburg (DE); Manfred Hoff, Bamberg (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 11/297,175

(22) Filed: Dec. 7, 2005

(65) Prior Publication Data

US 2006/0096339 A1 May 11, 2006

Related U.S. Application Data

(62) Division of application No. 10/332,427, filed as application No. PCT/DE01/02469 on Jul. 4, 2001.

(30) Foreign Application Priority Data

Jul. 4, 2000 (DE) ..... 100 33 309

(51) Int. Cl.
*E05B 3/00* (2006.01)

(52) U.S. Cl. ..... 70/208; 70/224; 70/451; 70/466; 292/336.3; 292/DIG. 53; 292/DIG. 64; 49/460

(58) Field of Classification Search ..... 70/208, 70/224, 451, 466, 204–206, DIG. 31, DIG. 33, 70/DIG. 32; 49/460; 292/336.3, 347, 348, 292/352, 355, DIG. 26, DIG. 31, DIG. 53, 292/DIG. 64, DIG. 27, DIG. 60, DIG. 61, 292/DIG. 63

See application file for complete search history.

(56) References Cited

U.S. PATENT DOCUMENTS 4,283,155 A 8/1981 Yamazaki et al.
4,478,445 A 10/1984 Shimizu
4,580,822 A 4/1986 Fukumoto
4,591,196 A 5/1986 Kurita
4,796,934 A 1/1989 Kesel et al.
4,861,081 A 8/1989 Satoh
5,660,420 A 8/1997 Smith et al.
5,794,995 A * 8/1998 Creesy et al. ..... 292/348
6,036,244 A 3/2000 Tyves et al.
6,059,329 A 5/2000 Spitzley
6,141,914 A * 11/2000 Feige et al. ..... 49/503
6,308,998 B1 10/2001 Armbruster et al.

(Continued)

FOREIGN PATENT DOCUMENTS

DE 33 44 699 A1 6/1987

(Continued)

OTHER PUBLICATIONS

International Search Report of corresponding International Application No. PCT/DE01/02469, dated Oct. 30, 2001.

(Continued)

*Primary Examiner*—Lloyd A. Gall
(74) *Attorney, Agent, or Firm*—Christie, Parker and Hale, LLP

(57) ABSTRACT

A vehicle door closure includes a door lock containing a closing element, an outer opening handle pivotally mounted in a holding plate or handle shell of the vehicle door, a coupling element connecting the door lock to the outer opening handle and a connecting device that connects the coupling element to the outer opening handle and compensates for tolerances between the door lock and the outer opening handle. The connecting device is arranged in the coupling element in such a way that it can be moved longitudinally and connected to the coupling element in a positive or non-positive fit manner during assembly of the outer opening handle, the connecting device being locked on the coupling element.

16 Claims, 6 Drawing Sheets

U.S. PATENT DOCUMENTS

| | | | | |
|---|---|---|---|---|
| 6,363,577 | B1 | 4/2002 | Spitzley | |
| 6,523,871 | B1 * | 2/2003 | Josserand | 292/347 |
| 6,644,074 | B1 | 11/2003 | Monig | |
| 2003/0155780 | A1 | 8/2003 | Bucker et al. | |

FOREIGN PATENT DOCUMENTS

| | | | |
|---|---|---|---|
| DE | 40 05 369 | A1 | 9/1990 |
| DE | 196 19 869 | A1 | 12/1996 |
| DE | 198 08 375 | A1 | 9/1999 |
| DE | 198 42 358 | A1 | 3/2000 |
| DE | 198 42 359 | A1 | 3/2000 |

OTHER PUBLICATIONS

International Preliminary Examination Report of Corresponding International Application No. PCT/DE01/02469, dated Sep. 20, 2002.

English Translation of International Preliminary Examination Report of corresponding PCT/DE01/02469, dated Sep. 20, 2002.

* cited by examiner

Fig. 9
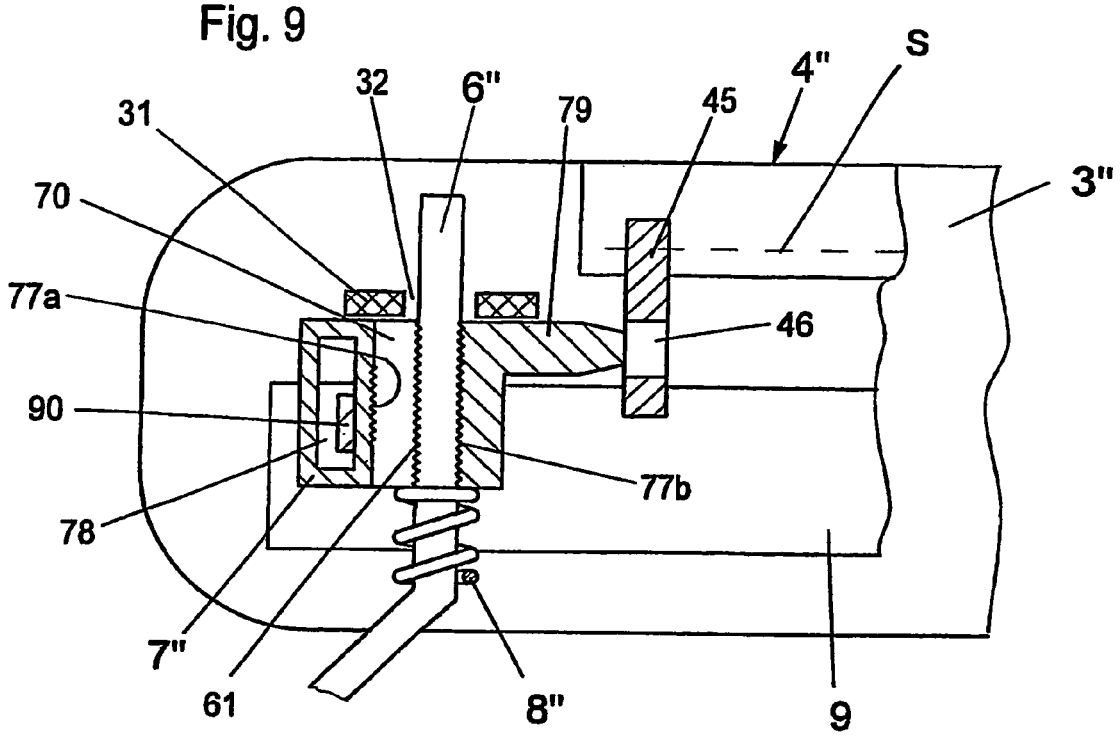
Fig. 10
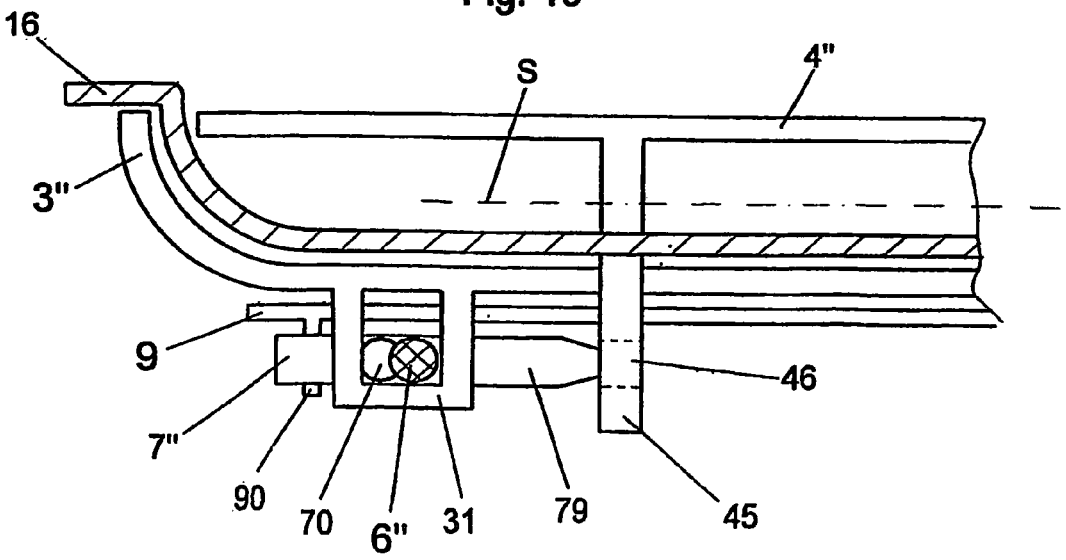
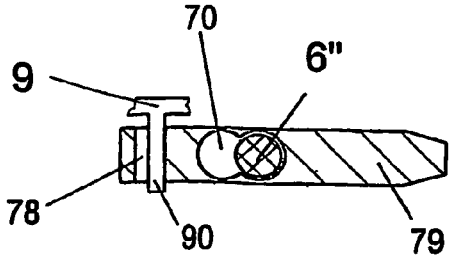
Fig. 11

VEHICLE DOOR CLOSURE

CROSS-REFERENCE TO RELATED APPLICATION

This application is a divisional of U.S. patent application No. 10/332,427, filed on Jul. 15, 2003, which is a National Phase Patent Application of International Application Number PCT/DE01/02469, filed on Jul. 4, 2001, which claims priority of German Patent Application Number 100 33 309.5, filed Jul. 4, 2000, the disclosure of which are incorporated herein by reference.

BACKGROUND OF THE INVENTION

The invention relates to a vehicle door closure.

DE 198 42 359 A1 describes a vehicle door closure with a door lock comprising closing elements (rotating latch, locking catch, release lever), an outer opening handle connected to an outer activating element plate and an outer coupling element connecting the closing elements of the door lock to the outer opening handle. In order to convert an essentially horizontal activation stroke of the outer opening handle formed as a pull handle into an essentially vertical activation stroke of the outer coupling element a deflection arm is connected to the outer activating element plate.

In order to ensure the problem-free opening function of the vehicle door closure in spite of the varied fixing of the outer opening handle and the door lock on the door outer panel or on the door inner panel, a door module or a support plate, tolerance compensation with adjustable rod systems is provided between the door lock and the outer opening handle and this is realized in the vehicle door closure known from DE 198 42 359 A1 through dividing the outer coupling element into two parts which can be connected to each other by means of a clamping device in a non-positive fit manner. During the course of the assembly of the vehicle door closure at least one of the part rods of the clamping device can be moved and fixed wherein for the purpose of fixing the part rod in question the clamping device can be activated through an inlet opening arranged in the front panel of the vehicle door by means of a tool which can be guided through the inlet opening.

DE 198 42 358 A1 describes a vehicle door closure of the same type with closing elements, an activating lever system acting on the closing elements and an outer opening handle for the outer activation of the activating lever system as well as an outer activating rod acting on the activating lever system. In order to facilitate tolerance compensation in relation to the outer activating rod in the course of the lock assembly, the outer activating rod is divided into a first and second part rod and the two part rods are connected to each other by means of a compensating device. The compensating device has a compensating lever which can be connected to the first part rod and a second compensating lever which can be connected to the second part rod wherein the two compensating levers can be pivoted or moved against each other and can be fixed to each other by means of a tool which can be guided into the door from outside.

These two constructions facilitate the required tolerance compensation but they are awkward and therefore time-consuming to assemble and cannot be achieved without the use of a tool in the form of a screwdriver. This makes assembly more difficult, particularly since the application point for the screwdriver lies relatively far into the door inner area and is not easily seen.

DE 196 19 869 A1 describes a vehicle door closure with a connecting device producing tolerance compensation between the outer opening handle and the door lock. The connecting device consists of a fixing component arranged on the handle-side end of the activating lever connecting the outer opening lever to the closing elements of the door lock with a profile which is assigned to a mating profile situated on an attachment of the outer opening handle. The two profiles can be connected to each other in a multitude of positions lying behind each other in the longitudinal direction of the coupling element.

The accurate positional assembly of the outer opening handle and its correct functional connection by means of a deflection arm and the coupling element adapted in its length to the respective assembly case and therefore to the tolerances to the door lock, takes place in that the outer opening handle is mounted in a handle shell or outer activating element plate and is then pivoted onto the door outer panel until it reaches its pre-determined position. Afterwards the coupling element which is either pre-assembled or inserted from outside through a recess is fixed, and the fixing component arranged on the handle-side end of the coupling element is pressed with its profile into the mating profile against an attachment.

In contrast with the constructions observed above, in this embodiment of a vehicle door closure no additional tool is needed, but as with the above-mentioned constructions an additional work stage is required in order to produce the necessary tolerance compensation and to ensure a secure connection of the components of the vehicle door closure. As this security-related connection depends upon the person carrying out the task, additional costs arise with a necessary final check of the quality assurance of this manual assembly.

DE 198 08 375 A1 describes a method of producing a Bowden cable connection between a lock activating handle and a vehicle door lock wherein undesired relative movements between the casing and the core of the Bowden cable, which lead to undesired empty paths in the Bowden cable in such a way that the lock cannot be unlocked in subsequent operation, can be avoided through several procedural stages. In a first procedural stage the Bowden cable is intercepted with one of its core ends with a movable inlet component of the lock and the associated casing end on the lock. In a second procedural stage the other core end is connected to the activating handle for the lock and the other casing end is intercepted near the activating handle. Between the two procedural stages either a stop for the other casing end is fixed on the core, length tolerance compensation is carried out or the core and the casing of the Bowden cable are clamped together.

DE 40 05 369 A1 describes a closing device on a vehicle door with a lock and an outer handle as well as an activating lever working in association with the outer handle wherein, for the purpose of avoiding incorrect adjustments, the activating lever is produced from two parts, of which the relative position can be adjusted by means of an elongated hole arrangement and a screw connection. When the screw connection is released between the two parts of the activating lever a spring provided there becomes effective and pivots the activating level in the direction of the outer handle.

DE 35 44 699 A1 describes a rod of a rod system between the door handle and the door lock extending from a door handle component of a vehicle door handle connected to a rod leading to the door lock by means of a non-positive socket joint with a bolt-form or rod-form insertion component and a receiving component surrounding the same which forms a friction locking mechanism or a shape locking mechanism for the insertion component and therefore to avoid the subsequent adjustment of a screw connection necessary for taking up manufacturing tolerances.

FR-A-2 649 152 describes a vehicle door closure with a door lock which by means of a rod system of a coupling mechanism is connected to an outer opening handle formed as a folding handle which can be pivoted about an axis wherein this outer opening handle is arranged in a handle shell which is allowed in a door outer frame. The coupling mechanism consists of a hook-shaped fork which has an opening for receiving an activating component connected to the folding handle. The coupling mechanism for connecting the fork to the rod system of the door lock has a rod which in an axial direction is inserted in a pipe-form casing and contains a toothed rack section which with the exception of the ends of the rod runs in the longitudinal direction of the rod. The teeth of the toothed racks are ring-shaped and formed coaxially to the axis of the rod and the casing. Each tooth has an upper surface running perpendicular to the axial direction of the rod as well as an upper surface running inclined to this axis. The casing has flexible claws which engage with the teeth of the toothed rack and ensure the axial connection between the rod and the casing.

In order to connect the folding handle to the door lock the folding handle is inserted in the handle shell and engages with the activating component in the opening of the hook-shaped fork. Through pivoting of the folding handle the hook-shaped fork and with it the rod are displaced in relation to the casing and a positive and non-positive fit connection between the folding handle and the door lock is thereby produced.

SUMMARY

It is the object of the present invention to create a vehicle door closure which requires only one work stage for the different outer opening handles formed as manual pull handles or folding handles and the necessary tolerance compensation between the components arranged on different parts of the vehicle door closure and a secure connection of the components irrespective of the care of the person carrying out the task in such a way that an additional final check for quality assurance of the security-related connection of the components is not required and wherein the outer opening handle can only be brought into the position of use after the locking of the components with the coupling element.

The solutions according to the invention ensure that for the necessary tolerance compensation between the various parts of the vehicle door closure an additional work stage for adjusting the fixing the connecting device is not necessary in the production of a secure connection of the components of the vehicle door closure and at the same time a problem-free securing of the connecting device is ensured irrespective of the care of the person carrying out the task. Assembly is thereby simplified and through a reduction in the labor costs and the quality assurance resources the manufacturing costs are reduced.

With the solutions according to the invention a positive and/or a non-positive fit connection of the connecting tool to the coupling element can be achieved without a special tool with a locking element itself and without additional labor resources and a secure connection of the two components is thereby provided with the necessary tolerance compensation. The assembly process is determined through the construction in such a way that the secure connection and the tolerance compensation are guaranteed irrespective of the care of the person carrying out the task and the outer opening handle can only be brought into the position of use after locking of the components with the coupling element. In order to ensure a problem-free connection of the connecting device to the coupling element for the production of the tolerance compensation without the necessity of checking the correct arrangement and the secure positioning, the functioning ability of the outer opening handle is therefore only produced once a secure connection has been produced between the connecting device and the coupling element.

In order to ensure that the tolerance compensation is for example maintained even if the components of the vehicle door closure are out of line the connecting device mounted in a displaceable way on the coupling element is compressed in a direction compensating for the tolerances between the door lock and the manual pull handle.

For the simpler assembly and for the clear assignment of the individual components of the vehicle door closure, the handle shell, the door lock and the coupling element are arranged on a support element.

Preferably the manual pull handle is moved in one direction for the connection of the connecting device to the coupling element and in another direction in order to reach the position of use or in the same direction for the connection of the connecting device to the coupling element as for reaching the position of use.

After the pivoting or insertion of the manual pull handle in the handle shell or outer activating element plate firstly the receiving element of the connecting device is fixed on the coupling element with the setting of the required tolerance compensation wherein the manual pull handle during its assembly is moved firstly in the direction of the connecting device and then for example displaced in a movement direction running perpendicular hereto. This displacement ensures that after the engagement of the connecting device the freedom of movement of the coupling element is guaranteed.

Through this constructive formation and assignment of the components of the vehicle door closure the manual pull handle can only reach its position of use if during assembly the connection has been produced between the coupling element and the connecting device.

The receiving element preferably consists of a box profile with slots in surrounding the coupling element and the locking element preferably consists of a U-shaped nose which can be inserted into the slotted box profile of the receiving element wherein the side inner surfaces of the engagement nose lie against the coupling element and in the locking position it finishes with its base surfaces flush with the open side of the slotted box profile.

This embodiment of the connecting device ensures in a particularly simple and therefore cost-effective form the pre-condition for a positive and/or non-positive fit connection of the connecting device with the coupling element through the manual pull handle/a part of the manual pull handle wherein this form of connection is also particularly space-saving.

For the purpose of locking the connecting device the manual pull handle can preferably be inserted or pivoted perpendicular to the door plane until the connecting device is connected in a positive and/or non-positive fit manner with the coupling element. The manual pull handle can only be displaced in the door plane preferably into the position of use once the connecting device has been connected to the coupling element.

In this embodiment the manual pull handle preferably has an activating surface running in an inclined way to its direction of insertion wherein this activating surface after locking of the connecting device slides along the same until the release of the displacement of the manual pull handle into the position of use.

The connection and locking between the connecting device and the coupling element can thereby take place, as an alternative to a displacement of the locking element formed as part of the connecting device at right angles to the longitudinal axis of the coupling element, through pivoting of the locking element about an axis of the receiving element or through rotation of the locking element about the coupling element.

As an alternative to this, the locking element can be arranged in the assembly position in a rotating or pivoting way in the receiving element and have an ellipse-shaped or polygonal recess which engages around an ellipse-shaped or polygonal coupling element wherein the manual pull handle has an activating shoulder which upon displacement of the manual pull handle into the position of use engages on a cam of the locking element and pivots the locking element in the receiving element as well as about the coupling element and produces a positive and/or non-positive fit connection between the receiving element and the locking element.

In this embodiment of the solution according to the invention the locking element preferably consists of a hard material, preferably a sintered material, and the coupling element consists of a material which is softer in comparison with the material of the locking element, preferably synthetic material.

In order to ensure the locking of the connecting device on the coupling element positive fit elements or regions can be provided on the receiving element which secure the position of the locking element on the receiving element and therefore the position of the connecting device on the coupling element.

Furthermore, or as an alternative, in order to ensure the locking of the connecting device on the coupling element the locking element can be rotatable by more than 90° from the position in which it is connected to the receiving element as far as the locking position of the connecting device on the coupling element in such a way that a self-securing connection is created as in this position the small ellipse axis of the ellipse-shaped recess of the locking element is rotated by more than 90° in relation to the large ellipse axis of the coupling element.

When the outer opening handle is a folding handle which can be pivoted about a horizontal pivot axis automatic clipping between the rod system and the folding handle is carried out. Due to different structure of the folding handle in relation to a manual pull handle which can be pivoted about a vertical axis the clip is, however, not automatically locked during assembly of the folding handle but instead after the assembly of all functional and assembly components of the vehicle door closure through the displacement of a locking slide member as a functional or assembly component of the vehicle door closure which can be displaced parallel to the pivot axis of the folding handle and is in effective connection with the connecting device. This locking slide member clamps the handle part of the folding handle with the holding plate and additionally the coupling element with the connecting device (clip) and guides the connecting device into an opening of the handle part.

The locking slide member therefore connects the connecting device to the coupling element, locks this connection and couples, at the same time or upon further displacement of the locking slide member, the folding handle with the connecting device and fixes at the same time the folding handle on the holding plate.

The connecting device is preferably pre-assembled on the locking slide member in such a way that easier assembly and assignment of the assembly and functional components is ensured.

In a preferred embodiment the connecting device has a recess for receiving the coupling element, an insertion bar running parallel to the movement direction of the locking slide member and an opening for receiving a tongue of the locking slide member. The tongue of the locking slide member projecting into the opening of the connecting device presses the connecting device during assembly into its final assembly position and pulls the connecting device out of the assembly position once again for the purpose of dismantling and thus facilitates the dismantling of the outer opening handle.

During or after the connection of the connecting device to the coupling element and the fixing of the folding handle by means of the locking slide member the holding plate can be fixed on the door outer panel.

The locking slide member can preferably be activated from the door front side.

Both in the assembly position and in the locking position the locking of the connecting device on the coupling element is to be secured. This takes place preferably in that on the coupling element and/or at least on part of the surface of the connecting device surrounding the coupling element positive fit elements, preferably toothing or micro-toothing, are arranged.

Alternatively the positive fit elements can be arranged on an insert consisting preferably of a sintered material which is inserted in the opening surrounding the coupling element of the connecting device which is preferably formed from synthetic material.

Further possibilities consist in forming the positive fit elements on the coupling element and on the inner surface of the hole of the connecting device as micro-toothing or on the coupling element at least in the connecting region with the connecting device providing a profiled upper surface wherein the locking surfaces of the connecting device lying against the coupling element have at least partly a profile which preferably corresponds to the profiled upper surface of the coupling element.

A method of connecting a vehicle door closure with a door lock containing closing elements and an outer opening handle formed as a manual pull handle is characterised in that a) in a first assembly phase the outer opening handle is guided on the one hand on the handle shell and on the other hand is pivoted with an activating flank of the outer opening handle in the direction of the connecting device consisting of a receiving element and a locking element until the locking element and an activating surface of the activating flank engage, b) in a second assembly phase a complete connection between the coupling element and the connecting device is produced and c) in a third assembly phase the outer opening handle is brought into its position of use wherein the activating flank disengages once again from the connecting device.

A method of connecting a vehicle door closure with a door lock containing closing elements and an outer opening handle formed as a folding handle is characterised in that a) the connecting device is connected to a locking slide member which can be displaced parallel to the pivot axis of the outer opening handle, placed on the coupling element and pressed with a compression force against a stop connected to the holding plate, b) through displacement of the locking slide member the connecting device is connected to the coupling element and fixed in a locking position, and c) through further displacement of the locking slide member the outer opening handle is coupled with the connecting device and the outer opening handle is fixed in a position of use.

In the last-mentioned method the thus assembled vehicle door closure can be dismantled in that through displacement of the locking slide member in the opposite direction to the connection direction the outer opening handle can be decoupled from the connecting device and through further displacement of the locking slide member the connecting device can be separated from the coupling element.

BRIEF DESCRIPTION OF THE DRAWINGS

With the aid of an embodiment shown in the drawings the thought behind the invention will be described in greater detail. The drawings show:

FIG. 9 is a section of the vehicle door closure according to FIG. 8 is a side view;

FIG. 10 is a longitudinal section through the vehicle door closure according to FIG. 9 and FIG. 11 is a section through an insertion bar of the connecting device and the coupling element according to FIGS. 8 to 10 in the pre-assembly position.

DETAILED DESCRIPTION

Figure 1:
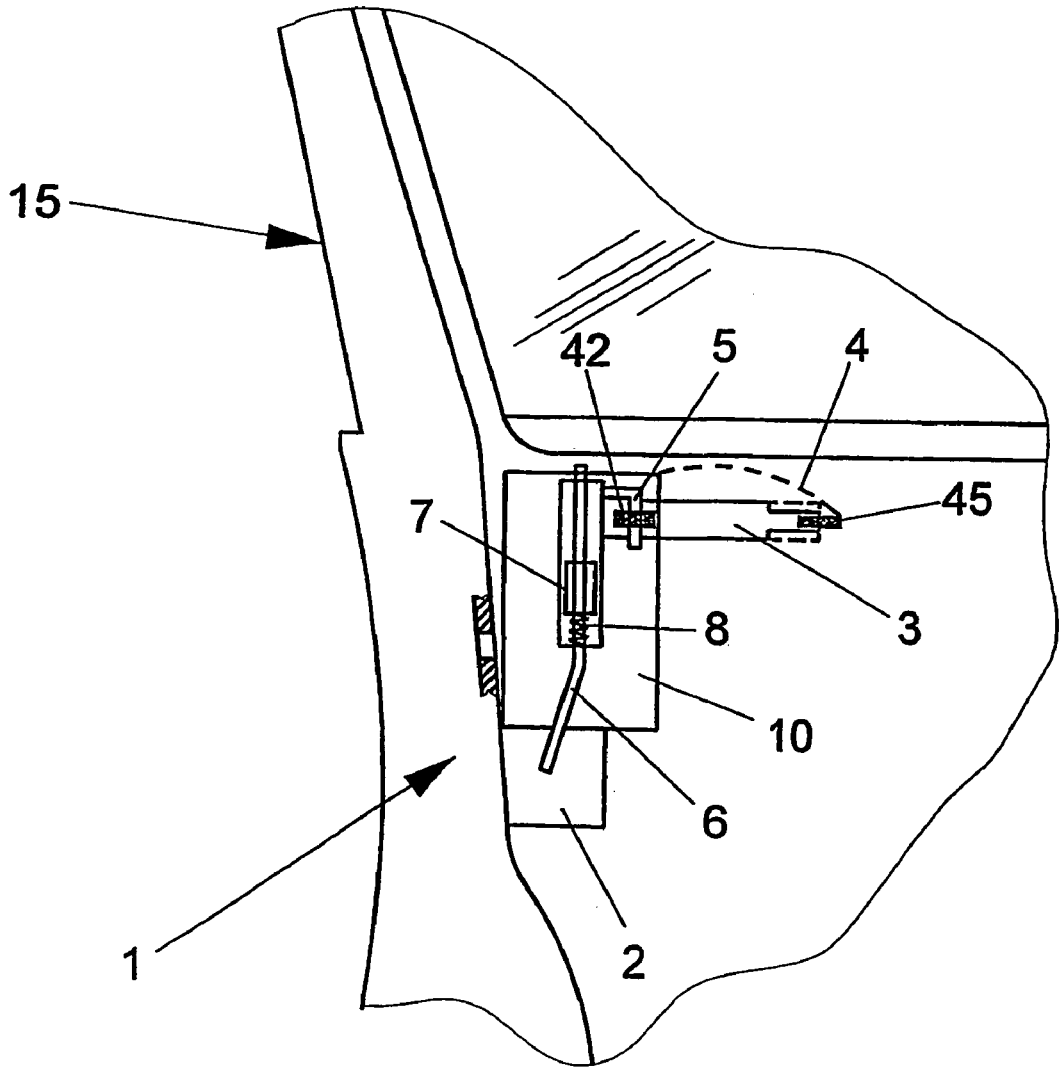
FIG. 1 is a section of a vehicle door with a schematic-perspective representation of a vehicle door closure for an outer opening handle formed as a manual pull handle which can be pivoted about a vertical axis.

The section of a vehicle door shown in FIG. 1 in the area of the vehicle door closure 1 schematically shows the door lock 2 which has several locking elements, amongst other things a rotating latch, a locking catch and a release lever as well as an activating lever system acting on the locking elements. The outer activation of the door lock 2 takes place by means of an outer opening handle 4 arranged in a handle shell or holding plate 3 which for the purpose of outer activation of the activating lever system of the door lock 2 acts by means of a coupling element 6, for example in the form of an activating rod, which works on the activating lever system and is formed in this embodiment as a manual pull handle which can be pivoted about a vertical pivot axis.

In this embodiment of the outer opening handle 4 in the form of a manual pull handle in order to transform a horizontal activation stroke of the manual pull handle into an essentially vertical activation stroke of the connected coupling element 6, an activating flank 42 of the manual pull handle 4 according to FIG. 1 is connected by means of a deflection arm 5 to the handle shell and suspended with a component 45 in a holding plate 3 in such a way that this suspension forms the swivel axis for the outer opening handle 4.

Between the coupling element 6 and the outer opening handle 4/the deflection arm 5, a connecting device 7 is arranged which in the assembly position, that is to say before the adjustment and fixing of the connecting device 7 on the coupling element 6, is mounted in a freely movable way. This free movement facility of the connecting device 7 ensures the necessary tolerance compensation between the outer opening handle 4 and the door lock 2, as the two components are arranged on different parts of the door bodywork and are subjected to corresponding manufacturing tolerances. This tolerance compensation is brought about by a corresponding displacement of the connecting device 7 on the coupling element 6 wherein a spring 8 produces a compression which moves the connecting device 7 in the direction of the outer opening handle 4.

Through the tolerance compensation assembly, tolerances between the door lock 2 and the outer opening handle 4 are compensated for to the extent that in every case problem-free co-operation between the outer opening handle 4 and the door lock 2 is guaranteed.

In order to simplify the assembly, the above-described components are—with the exception of the outer opening handle 4—pre-assembled on a support element 10 which is inserted in the vehicle door or assembled on a support component of the vehicle door before the outer opening handle 4 is inserted or pivoted into the vehicle door closure 1.

Figure 2:
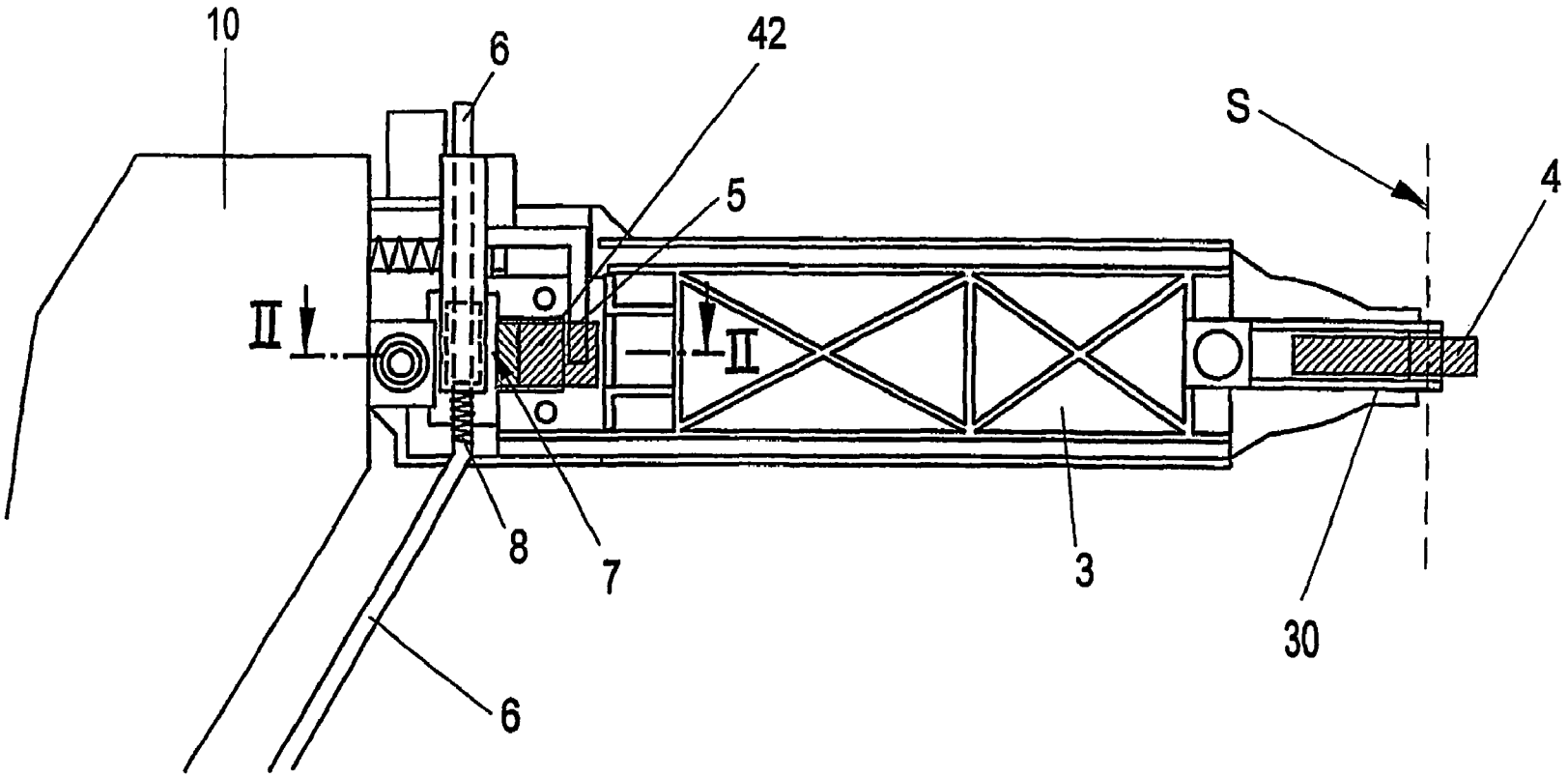
FIG. 2 is a section of the vehicle door closure according to FIG. 1 in a side view.

FIG. 2 shows a section of the vehicle door closure according to FIG. 1 in the region of the outer opening handle 4 in a view from the inner side of the vehicle door in such a way that the outer opening handle 4 can only be partly seen.

The outer opening handle 4 is suspended with a component 45 in a suspension area 30 of the handle shell/holding plate 3 which forms a vertical pivot axis S for the outer opening handle 4. The outer opening handle 4 acts by means of an activating flank 42 upon a deflection arm 5 which converts the horizontal pivot movement of the outer opening handle 4 into an essentially vertical movement. The deflection arm 5 acts by means of a connecting device 7 formed in this embodiment as a two-part clip upon a coupling element 6. In the assembly state a part of the connecting device 7 is arranged on the coupling element 6 in a freely movable way in the longitudinal direction of the coupling element 6/is pressed upwards under the impact of a spring 8 for the above-mentioned tolerance compensation in the representation according to FIG. 2 in such a way that the compression always works in this direction.

The connecting device 7 which is mounted in the assembly position in a freely movable way on the coupling element 6 is then securely connected to the coupling element 6 in the locking position in such a way that problem-free assignment of the individual components of the vehicle door closure is possible.

Figure 3:
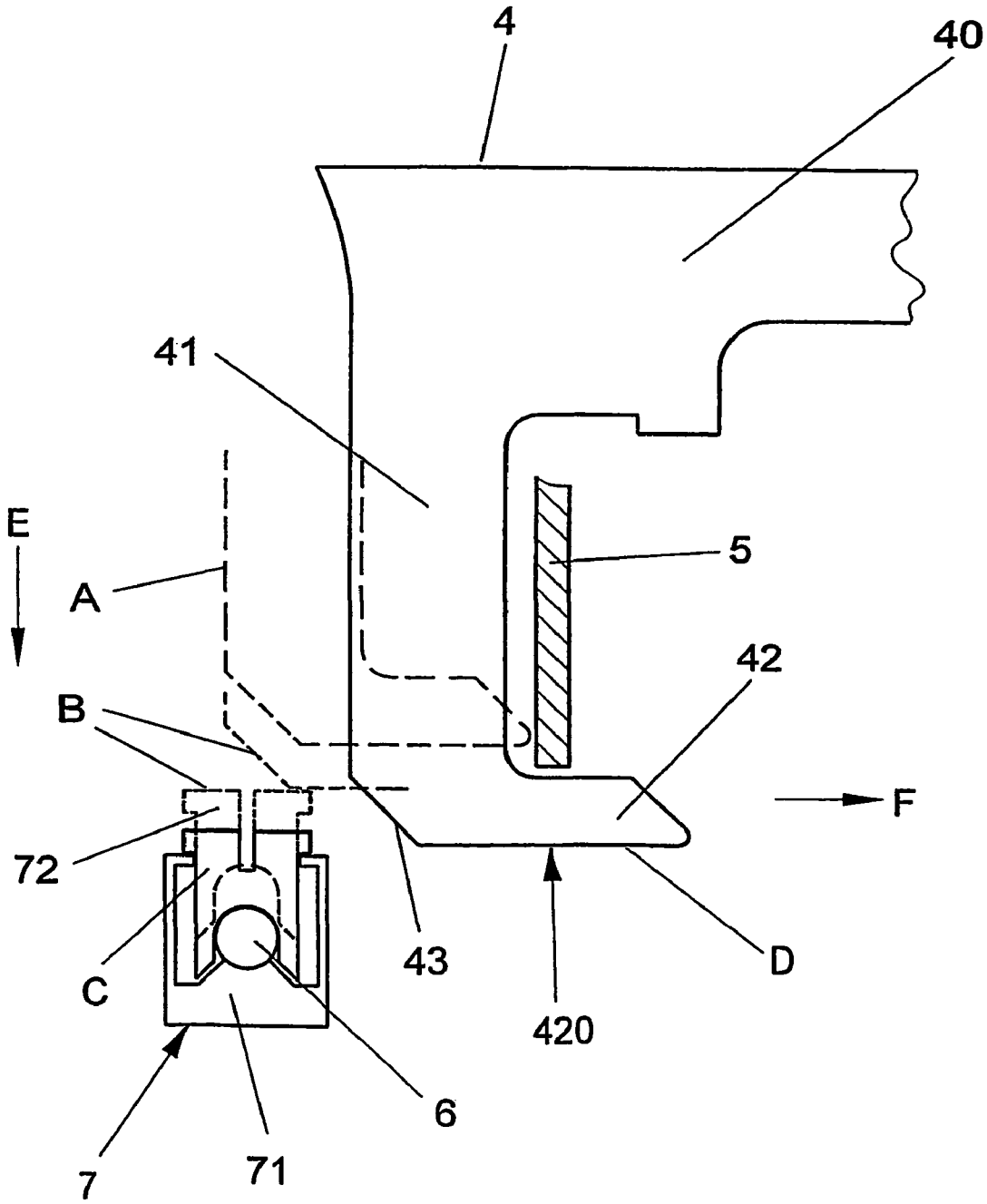
FIG. 3 is a section through the vehicle door closure according to FIG. 2 along the line II—II.

More detailed constructive information concerning the solution according to the invention as well as the mode of operation of the solution according to the invention can be obtained from the section shown in FIG. 3 through the vehicle door closure according to FIG. 2 along the line II—II.

The outer opening handle 4 formed as a manual pull handle has a handle flank 40 which is connected by means of a connecting flank 41 to an activating flank 42. In the assembly position A the outer opening handle 4 lies with the end of the activating flank 42 against a side surface of the deflection arm 5 which therefore prevents pivoting of the outer opening handle 4 into the position of use.

The connecting device 7 has a receiving element 71 which preferably consists of a box profile with slots in with a corresponding contact surface on the coupling element 6. A locking element 72 formed as an engagement nose which has a U-shaped profile can be inserted in the slotted box profile of the receiving element 71 wherein the distance between the flanks corresponds essentially to the diameter of the coupling element 6. When the receiving element 71 and locking element 72 are connected to each other a secure positive and/or non-positive fit connection is produced between the connecting device 7 and the coupling element 6 wherein preferably the U-shaped locking element 72 lies against a stop of the receiving element 71 of the connecting device 7 and there is thereby a secure engagement connection with the receiving element 71.

If the outer opening handle 4 is pushed or pivoted during assembly in the direction of the arrow E into the handle shell an activating surface 420 of the activating flank 42 of the outer opening handle 4 lies against the front surface of the locking element 72 (phase B, dotted line in FIG. 3) and pushes the same via the coupling element 6 in the direction of a secure connection with the receiving element 71 of the connecting device 7 until the stop position, that is to say the locking position C which is shown in FIG. 3 with the line which has been run through, is reached.

In this locking position C no further displacement of the locking element 72 into the receiving element 71 of the connecting device 7 is possible and the inclined surface 43 provided between the connecting flank 41 and the activating flank 42 of the outer opening handle 4 slides along the outer surface of the locking element 72 wherein a movement of the outer opening handle 4 in the direction of the arrow F is released for the displacement of the outer opening handle 4 into the position of use. Through this displacement after the engagement of the connecting device 7 with the coupling element 6 the freedom of movement of the coupling element 6 is ensured.

Through this form of connection it is ensured that the outer opening handle 4 can only be displaced in the door plane into the position of use D and therefore assume the final state of assembly after connection of the connecting device 7 to the coupling element 6.

In order to ensure a positive and/or non-positive fit connection between the connecting device 7 and the coupling element 6, the coupling element 6 can have a profiled upper surface at least in the region of the connection with the connecting device, for example in the form of a thread or several rings and grooves arranged in the longitudinal direction of the coupling element 6. Through a corresponding mating profile on the inner flank surfaces of the locking element 72 a secure connection which cannot be released through vibrations is ensured between the individual components of the vehicle door closure.

The solution according to the invention allows various embodiments. For example the coupling element 6 can also consist of a pulling rope if for example solely pulling forces are to be transferred between the outer opening handle 4 and the door lock 2.

In the FIGS. 4 to 7, two alternative embodiments for connecting an outer opening handle to a coupling element are schematically shown. In these embodiments the coupling element 6' has an ellipse-shaped cross-section which can however also be replaced by a polygonal profile. The locking element 72' contains a likewise ellipse-shaped recess which in the assembly position engages around the ellipse-shaped coupling element 6'.

The outer surface of the locking element 72' is cylinder-shaped and is inserted in a partially cylindrical recess of the receiving element 71'. A cam 73 protruding from the outer surface of the locking element 72' outside of the connection with the receiving element 71' enters effective connection with a shoulder 44 on the activation surface of the outer opening handle 4' in such a way that after the insertion of the outer opening handle 4' and displacement into the position of use, the locking element 72' is pivoted about the coupling element 6' so that in the locking position (FIG. 5) a non-positive fit connection is produced between the locking element 72' and the coupling element 6'. Subsequently the outer opening handle 4' is displaced further into the position of use, in which it comes into contact with the deflection arm as shown in the representation according to FIG. 3.

Figure 4:
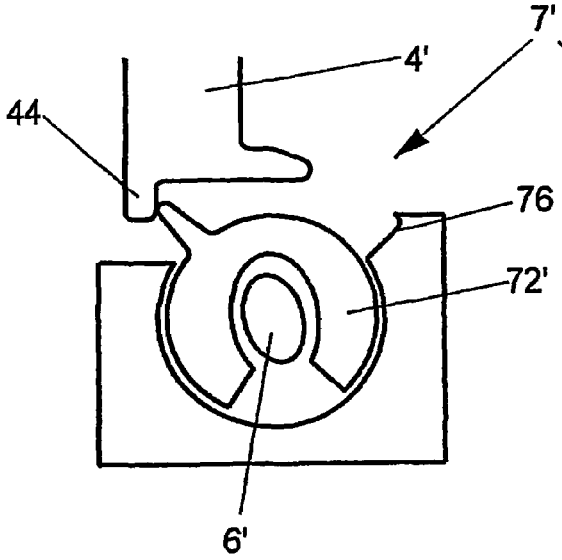
FIGS. 4–7 are alternative embodiments for connecting an outer opening handle to a coupling element.
Figure 5:
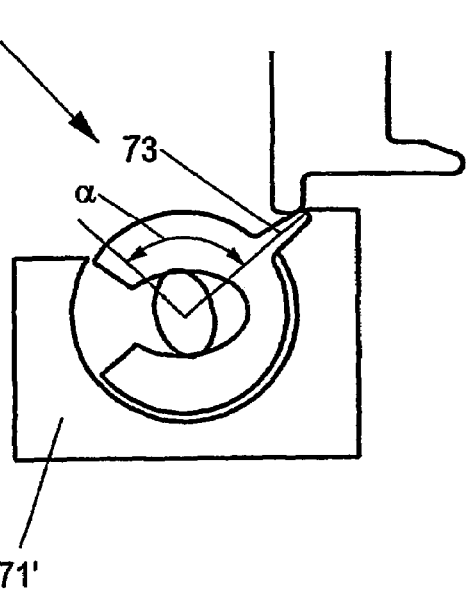

In the embodiment according to FIGS. 4 and 5 the locking element 72' consists preferably of a hard material, for example a sintered material, while the coupling element 6' consists of a softer material, for example synthetic material. This material pairing ensures that a secure non-positive fit and, if appropriate through deformation of the coupling element in the locking region, also positive fit connection between the locking element 72' and the coupling element 6' occurs.

In order to secure the connection between the connecting device 7' and the coupling element 6' different measures can be taken. For example according to FIG. 5 the receiving element 71' can be provided with a positive fit element or a positive fit region 76, with which the cam 73 of the locking element 72' can, after locking of the locking device 7' on the coupling element 6', be fixed in a positive fit manner.

Alternatively or complementarily, pivoting of the locking element 72', by an angle $\alpha$ of more than 90° from the starting position of the locking element 72' as far as locking of the connecting device 7' on the coupling element 6', can be provided in such a way that the locking element 72' engages in a self-securing way around the coupling element 6' as in this position the small ellipse axis of the ellipse-shaped recess of the locking element 72' is rotated by more than 90° in relation to the large ellipse axis of the coupling element 6' and therefore creates a self-securing connection between the locking element 72' and the coupling element 6'.

Figure 6:
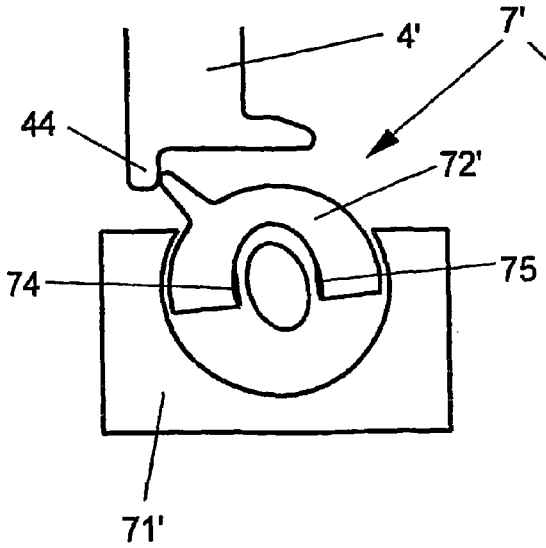
Figure 7:
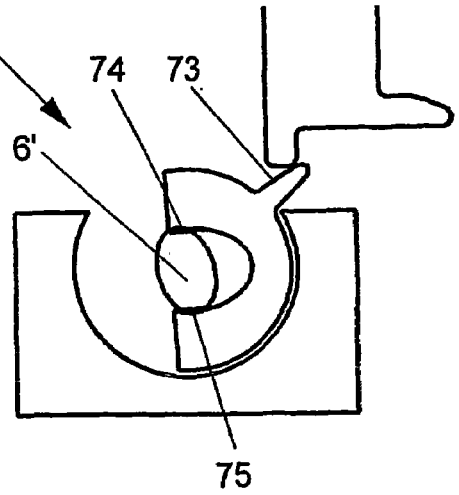

A further alternative or complement to this is shown in FIGS. 6 and 7.

The embodiment according to FIGS. 6 and 7 is of the same type as the embodiment shown in FIGS. 4 and 5. In this embodiment the locking element 72' has inserts 74, 75 preferably made from a sintered material, in whose surface facing the coupling element 6' toothing is arranged. This toothing ensures during locking of the locking element 72' with the coupling element 6' a secure positive and non-positive fit connection between the locking element 72' and the coupling element 6'.

Figure 8:
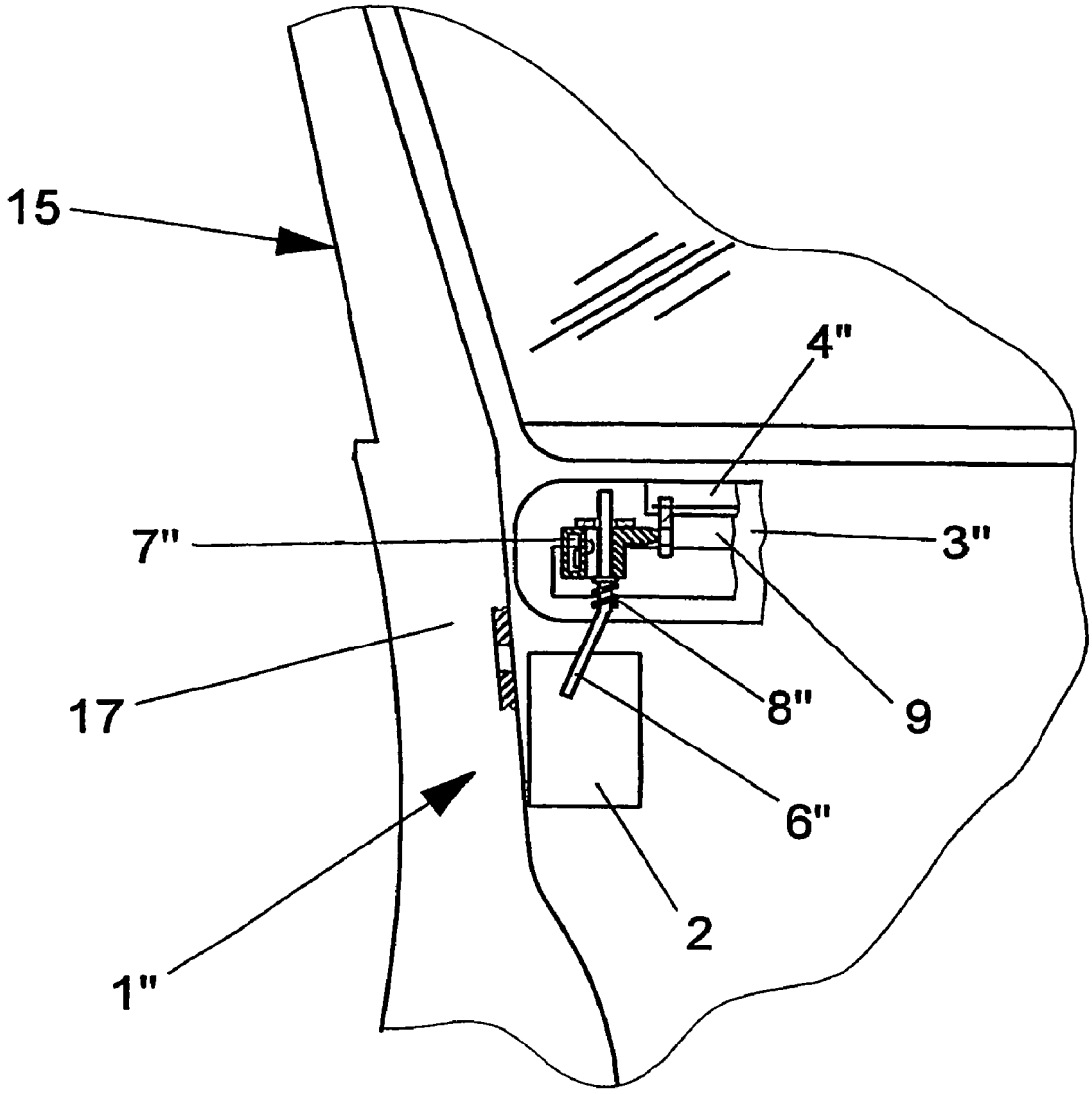
FIG. 8 is a section of a vehicle door with a schematic-perspective representation of a vehicle door closure for an outer opening handle formed as a folding handle which can be pivoted about a horizontal axis.

FIG. 8 shows a section of a vehicle door in the region of a vehicle door closure 1" as in FIG. 1 but—unlike this vehicle door closure—it is suitable for outer opening handles (folding handles) which can be pivoted about a horizontal pivot axis. Due to the different working mechanism of outer opening handles which can be pivoted about a vertical or horizontal pivot axis there are at the same time other possibilities of realization of the observation forming the basis of the invention wherein particularly suitable functional and/or assembly components of the vehicle door closure are selected and used as elements for producing the connection between the outer opening handle and the coupling element with compensation for the tolerances between the door lock and the outer opening handle.

In FIG. 8 a door lock 2 is likewise schematically shown wherein this door lock 2 has several locking elements such as a rotating latch, a locking catch and release lever as well as an activating lever system acting on these locking elements. The outer activation of the door lock 2 takes place by means of an outer opening handle 4" which can be pivoted about a horizontal pivot axis and which for the purpose of outer activation of the activating lever system of the door lock 2 acts upon the door lock 2 by means of a coupling element 6" formed as an activated rod.

As the outer opening handle 4" formed as a folding handle pivots about a horizontal axis and can thereby act directly upon the coupling element 6", a deflection arm 5 is not necessary as in the embodiment according to FIG. 1 and a direct connection can be produced between force-transferring parts of the outer opening handle 4" and the coupling element 6"/a connecting device 7" between the coupling element 6" and the outer opening handle 4". In the assembly position shown in FIG. 8 before adjustment and fixing of the connecting device 7" on the coupling element 6" the connecting device 7" is mounted in a freely movable way on the coupling element 6". This free movement facility of the connecting device 7" brings about the necessary tolerance compensation between the outer opening handle 4" and the door lock 2 which—as in FIG. 1—are arranged on different parts of the door bodywork 15 and are subject to corresponding manufacturing tolerances. Through this tolerance compensation component and assembly, tolerances between the door lock 2 and the outer opening handle 4" are compensated so much that problem-free co-operation between the outer opening handle 4" and the door lock 2 is always guaranteed.

The tolerance compensation is produced in that the connecting device 7" producing the connection between the coupling element 6' and the outer opening handle 4" is pressed under the influence of a spring 8" against a stop of a holding plate 3" to be connected to the outer activating handle 4" in such a way that with different distances between the outer opening handle 4" and the door lock 2 the connecting device 7" fixes the coupling element 6" at different points.

For the purpose of assembling the vehicle door closure 1" a locking slide member 9, which can be displaced parallel to the pivot axis of the outer opening handle 4", is provided which is suitably connected to the connecting device 7" in such a way that through activation of the locking slide member 9 in particular from the door front side 17 of the door bodywork 15 an effective connection can be produced between the outer activating handle 4" and the door lock 2 with compensation of the component and manufacturing tolerances. At the same time the locking slide member 9 can serve for the pre-assembly of the connecting parts between the outer opening handle 4" and the door lock 2 in that it receives the connecting device 7" and the coupling element 6" guided in the connecting device 7" and therefore facilitates the handling of the door lock during assembly.

FIG. 9 shows a section of the vehicle door closure according to FIG. 8 in a view from the inner side of the vehicle door. The outer opening handle 4" which can be pivoted about a horizontal swivel axis S is schematically entered in this drawing. Furthermore FIG. 9 shows the holding plate 3" connected to the outer opening handle 4" as well as a receiving member 45 likewise connected to the outer opening handle 4" or formed as part of the outer opening handle 4" wherein this receiving member 45 transfers an activation of the outer opening handle 4" onto the door lock 2 according to FIG. 8 via the coupling element 6".

The coupling element 6" formed as an activating rod is arranged in a recess 70 of the connecting device 7" and additionally fixed in its position through a hole 32 in a stop 31 connected to the holding plate 3". The connecting device 7" furthermore has an opening 78, in which a tongue 90 of the locking slide member 9 engages and therefore holds the connecting device 7" in a pre-assembly position.

The connecting device 7" has furthermore an insertion bar 79 which is aligned with an opening 46 of the receiving member 45 of the outer opening handle 4". The position of the connecting device 7" in relation to the coupling element 6" is determined by the stop 31 and the spring 8" provided in order to achieve compression in such a way that depending upon the tolerance-related distances between the outer opening handle 4" and the door lock 2 according to FIG. 8 the connecting device 7" assumes another position in relation to the coupling element 6".

In order to connect the connecting device 7" to the coupling element 6" both in the pre-assembly position and in the locking position, the recess of the connecting device 7" has micro-toothing 77*a*/77*b* which faces corresponding micro-toothing 61 of the coupling element 6".

FIG. 9 shows the individual components of the vehicle door closure in the pre-assembly position, in which the micro-toothing 61 engages with the micro-toothing 77*b* of the connecting device 7".

FIG. 10 shows a section through the side view of the vehicle door closure according to FIG. 9 and FIG. 11 shows a single component representation of the insertion bar 79, the tongue 90 of the locking slide member 9 and the recess 70 of the connecting device with the coupling element 6" guided therein. Both FIGS. 10 and 11 clarify the arrangement and assignment of the individual components of the vehicle door closure.

In these views the special formation of the recess 70 of the connecting device 7" can be seen wherein this ensures a type of engaging transition from the pre-assembly position into the locking position and is for example formed as two holes lying beside one another, whose diameters overlap. If the connecting device 7" is brought by means of the locking slide member 9 from the pre-assembly position into the locking position, the coupling element 6" engages from one hole into the hole of the recess 70 which lies in the next position in relation to the tongue 90 and the micro-toothing 77*a* and the connecting device 7" and 61 of the coupling element 6" come into effect connection with each other.

In this locking positing the insertion bar 79 engages in the hole 46 of the receiving member 45 of the outer opening handle 4" and thus fixes at the same time the outer opening handle 4" on the holding plate 3".

In the pre-assembly position the connecting device 7" is positioned by the stop 31 and the spring 8" in relation to the coupling element 6". The fixing of the outer opening handle 4" takes place from the door front side 17 according to FIG. 8 by means of the locking slide member 9 which locks the outer opening handle 4" and then with the tongue 90 brings the connecting device 7" into locking engagement with the coupling element 6" and thereby fixes the previously freely movable coupling element 6".

Furthermore the locking slide member 9 pushes the insertion bar 79 of the connecting device 7" together with the coupling element 6" into the hole 46 of the receiving member 45 of the outer opening handle 4" and fixes the same likewise in this position.

For the purpose of dismantling the outer opening handle 4" the locking slide member 9 is moved into the opposite direction so that the tongue 90 moves the connecting device 7" in such a way that the insertion bar 79 is pulled out of the hole 46 and therefore the outer opening handle 4" and the coupling element 6" are released.

The invention claimed is:

1. A vehicle door closure comprising a vehicle door including one of a holding plate and a handle shell, a door lock containing locking elements, a folding handle pivotally mounted about a horizontal pivot axis in one of the holding plate and the handle shell of the vehicle door, a coupling element connecting the door lock to the folding handle, and a connecting device connecting the coupling element to the folding handle and compensation for tolerances between the door lock and the folding handle wherein the connecting device is arranged in a longitudinally displaceable way on the coupling element and by means of a locking slide member which leads to a door outer side and which is in effective connection with the connecting device, is displaceable parallel to a pivot axis of the folding handle, the connecting device connected in a fit manner with the coupling element, wherein the one of the holding plate and the handle shell has a stop for the connecting device, the stop provided with an opening for receiving the coupling element, wherein a spring pressing the connecting device in a direction compensating for the tolerances between the door lock and the folding handle presses the connecting device in a pre-assembly position against the stop.

2. The vehicle door closure according to claim 1 wherein the connecting device is pre-assembled on the locking slide member.

3. The vehicle door closure according to claim 1 wherein the locking slide member connects the connecting device to the coupling element, and couples the folding handle with the connecting device.

4. The vehicle door closure according to claim 2 wherein the connecting device has a recess for receiving the coupling element, an insertion bar running parallel to a movement direction of the locking slide member and an opening for receiving a tongue of the locking slide member.

5. The vehicle door closure according to claim 1 wherein during or after the connection of the connecting device to the coupling element and the fixing of the folding handle by means of the locking slide member, the one of the holding plate and the handle shell is fixed on the door outer panel.

6. The vehicle door closure according to claim 1 wherein the locking slide member is activated from the door front side.

7. The vehicle door closure according to claim 1 wherein on at least one of the coupling element and at least part of the surface of the connecting device surrounding the coupling element, positive fit elements are arranged.

8. The vehicle door closure according to claim 7 wherein the positive fit elements are arranged on an insert which is inserted in an opening of the connecting device.

9. The vehicle door closure according to claim 7 wherein positive fit elements in the form of micro-toothing are on the coupling element and on an inner area of an opening of the connecting device.

10. The vehicle door closure according to claim 7 wherein the coupling element at least in a connection region with the connecting device has a profiled upper surface.

11. The vehicle door closure according to claim 10 wherein locking surfaces of the connecting device lying on the coupling element have at least partly a profile which corresponds to a profiled upper surface of the coupling element.

12. The vehicle door closure according to claim 1, wherein the connecting device assumes a positive fit connection with the coupling element.

13. The vehicle door closure of claim 3, wherein the locking slide member fixes the folding handle on the one of the holding plate and the handle shell.

14. The vehicle door closure of claim 8, wherein the positive fit element of the insert comprises a sintered material.

15. A method of producing the connection of a vehicle door closure with a door lock containing locking elements according to claim 1 comprising connecting the connecting device to the locking slide member, placing the connecting device on the coupling element and pressing the connecting device against the stop connected to the one of the holding plate and the handle shell, through displacement of the locking slide member, connecting the connecting device to the coupling element and fixing the connecting device in a locking position, and through further displacement of the locking slide member, coupling the folding handle with the connecting device and fixing the folding handle in a position of use.

16. The method according to claim 15 further comprising dismantling the vehicle door closure with a door lock containing locking elements wherein through displacement of the locking slide member in an opposite direction to a connection direction, the folding handle is decoupled from the connecting device and through further displacement of the locking slide member, the connecting device is separated from the coupling element.

* * * * *

UNITED STATES PATENT AND TRADEMARK OFFICE

CERTIFICATE OF CORRECTION

PATENT NO. : 7,080,532 B2
APPLICATION NO. : 11/297175
DATED : July 25, 2006
INVENTOR(S) : Bücker et al.

It is certified that error appears in the above-identified patent and that said Letters Patent is hereby corrected as shown below:

On the Title Page

| | |
|---|---|
| (56) References Cited<br>Foreign Patent Documents | Delete "DE 33 44 699",<br>Insert --DE 35 44 699-- |

In the Claims

| | |
|---|---|
| Column 13, line 20, Claim 1 | Delete "compensation",<br>Insert --compensating-- |

Signed and Sealed this

Seventeenth Day of April, 2007

JON W. DUDAS
*Director of the United States Patent and Trademark Office*